United States Patent [19]

Bjorntwedt

[11] Patent Number: 4,620,396

[45] Date of Patent: Nov. 4, 1986

[54] PROTECTIVE COVER OF FLEXIBLE SHEET MATERIAL

[76] Inventor: Kris E. Bjorntwedt, 647 S.W. Veronica Ave., Port Saint Lucy, Fla. 33453

[21] Appl. No.: 729,752

[22] Filed: May 2, 1985

[51] Int. Cl.[4] ..... B32B 3/06

[52] U.S. Cl. ..... 52/3; 428/100; 428/194; 52/DIG. 13; 150/52 R

[58] Field of Search ..... 428/100, 194; 2/DIG. 6; 52/3, DIG. 13; 150/52 R

[56] References Cited

U.S. PATENT DOCUMENTS 3,024,824 3/1962 Bass ..... 150/52 R 3,185,197 5/1965 Spiro et al. ..... 2/DIG. 6

3,623,526 12/1969 Robertson ..... 428/100 X

*Primary Examiner*—Alexander S. Thomas

*Attorney, Agent, or Firm*—Scrivener Clark Scrivener and Johnson

[57] ABSTRACT

A cover sheet is provided with pairs of back-to-back Velcro strips, one being of the male variety and the other being of a female variety. The pairs are provided symmetrically about the sheet and extend from positions adjacent the periphery thereof towards the center of the sheet. The strips on one side are preferably all of the same type, female say, and the strips on the other are of the opposite type. The strips facilitate securing the sheets about objects or to each other to form enlarged sheets.

3 Claims, 5 Drawing Figures

PROTECTIVE COVER OF FLEXIBLE SHEET MATERIAL

This invention relates to protective covers particularly, though not exclusively, for use as pads in the household goods moving industry. More particularly the invention relates to an improved protective sheet or cover which can be quickly and easily secured about an article which might otherwise be subjected to marring or superficial damage in the absence of such a cover.

In the present day moving industry, quilted pads are utilized for wrapping around objects such as chairs or the like, but there is a problem in retaining the pads around the objects, the usual means being by the use of large elastic bands which must be manually expanded to pass partly over the object and then be released to clamp the pad around the object. It is a time consuming procecure not only to apply the bands but to remove them and, further, the bands can break and, if stretched too tightly, they can unduly stress delicate articles.

When the articles to be wrapped are too large for a single pad, heretofore the mover had to maintain an inventory of different sized pads or he made a larger pad from two or more standard-sized pads by taping together with adhesive backed tape e.g. duct tape, the adjacent edges of the pads. Maintaining a supply of oversized pads is expensive and taping the edges of smaller pads together is time consuming and therefore also expensive.

The broad object of the present invention is to overcome the foregoing problems with present day protective pads as used for example, in the household goods moving industry.

More particularly, it is an object of the invention to provide a protective pad or covering which may, by the use of Velcro, be quickly and easily wrapped and secured about an article, or releasably fastened to an adjacent pad to provide a larger pad thereby eliminating the need for any other securing means, such as rubber bands, twine, or adhesive backed tapes.

"Velcro" is a proprietary trademark and is generally recognized as a releasable fastener wherein a female member carrying closed loops can be attached to a male member carrying open hooks when the two members are brought into engagement with each other. The members are readily separated by pulling the members apart.

The foregoing and other objects will become apparent as the following detailed description is read in conjunction with the accompanying drawings wherein.

Figure 1:
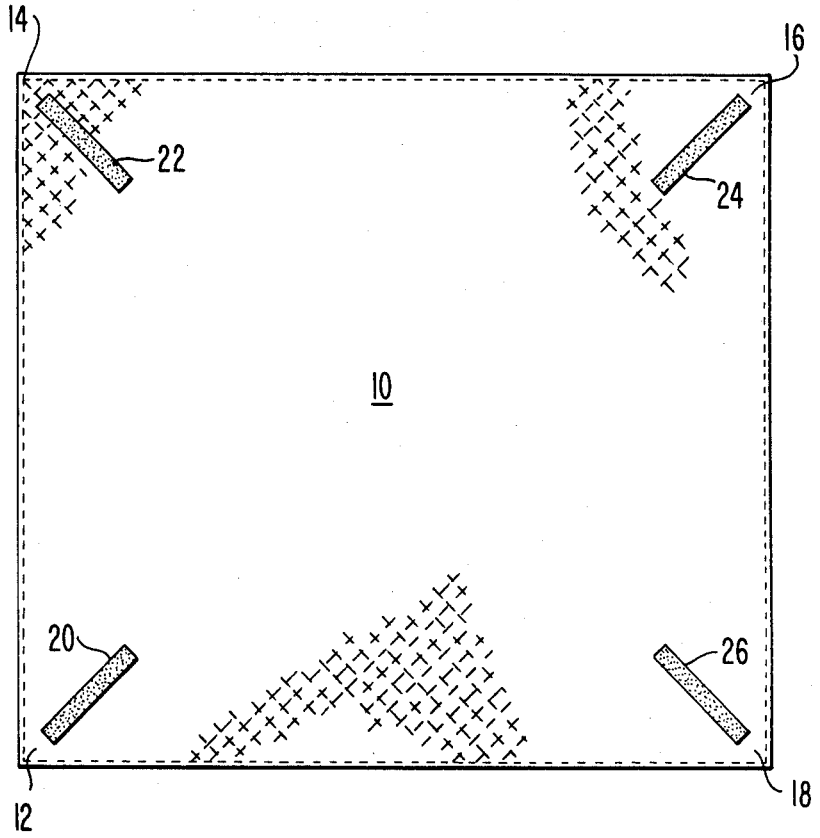
FIG. 1 is a plan view of a standard sized pad as used in the househould goods moving industry and incorporating the present invention.
Figure 2:
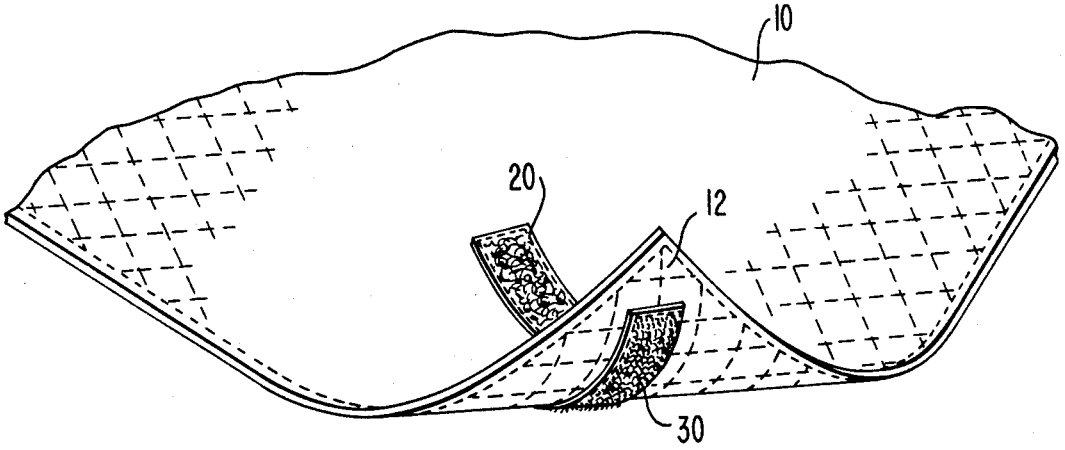
FIG. 2 is an enlarged detailed broken perspective view of a corner of a pad incorporating the present invention.

With reference now to the FIGS. 1 and 2, 10 designates a standard sized pad as customarily used in the household goods moving industry. Typically, the standard sized pad is a rectangular flexible sheet having a length of 80" and a width of 72" which is a size adequate for covering a wide range of articles. The pad has a thickness, usually provided by quilting, sufficient to protect an article covered thereby against marring or other superficial damage during handling transport or storage of the article.

For the purpose of quickly and easily securing the pad in wrapped condition about an article, and in accordance with the invention, I diagonally fix to each of the corners 12, 14, 16, 18 on one side of the pad a first strip of Velcro 20, 22, 24, 26, respectively. In each of the corners on the opposite side of the pad I diagonally fix a second strip in a position substantially overlying each one of the first strips as shown at 30 in FIG. 2. The first and second strips define pairs of substantially back-to-back strips in each corner on opposite sides of the pad, one strip of each pair, say strip 20 in FIG. 2 being a female type and the other strip of the pair, strip 30 in FIG. 2, being a male type. Preferably, all of the strips on one side of the pad are of the same type, male or female, and all of the strips on the other side are of the opposite type.

Figure 3:
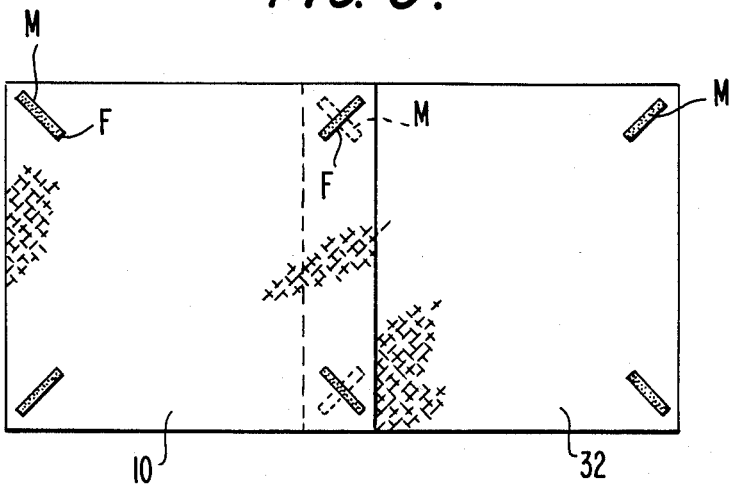
FIG. 3 is a reduced view showing the manner in which two pads are releasably connected together by use of the invention.

An advantage of having all strips on a side of the same type can be appreciated from FIG. 3. When a pad larger than a standard pad is desired, one simply overlaps the edge of one pad 10 with the edge of a second pad 32 until the diagonal male strips, say, on one side of the pad 10 intersect the female strips on one side of the pad 32. The strips are preferably about 2" wide and 12" long, their overlapping portions thus providing a connecting area of about 4 square inches, which is ample to provide a secure connection of one pad to another. It will be apparent from an inspection of FIG. 3, that one pad may be adjusted laterally with respect to the other over a wide range and still provide the desired 4 square inch overlapping area for a secure connection of one pad to the other. It will also be apparent that for an irregularly shaped article it may be desirable to attach a third pad to the upperside of the pad 32, say, there being two exposed unused strips on the opposite side of the pad 32 with which the appropriate strips on the third pad can be aligned, or the two upper (or lower) unused strips on the exposed side of the pad 10 in FIG. 3 can be used. From the foregoing it will be apparent that a protector of almost unlimited size can be made by joining together any number of standard sized pads, it being also noted that there will be exposed strips on one side or the other of the enlarged pad which are of the appropriate type, male or female, which will permit the enlarged pad to be secured around an article in the same fashion as a single pad, as fully explained below in conjunction with FIGS. 4 and 5.

Figure 4:
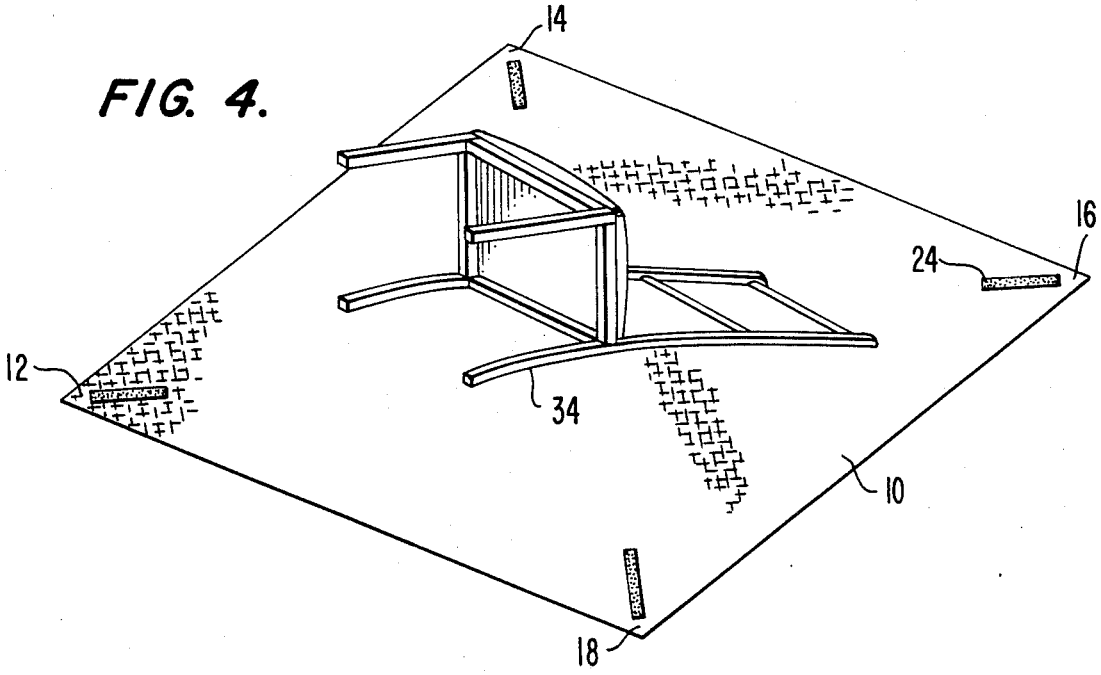
FIG. 4 is a perspective view showing the initial disposition of an article which is to be wrapped in a pad incorporating the invention.
Figure 5:
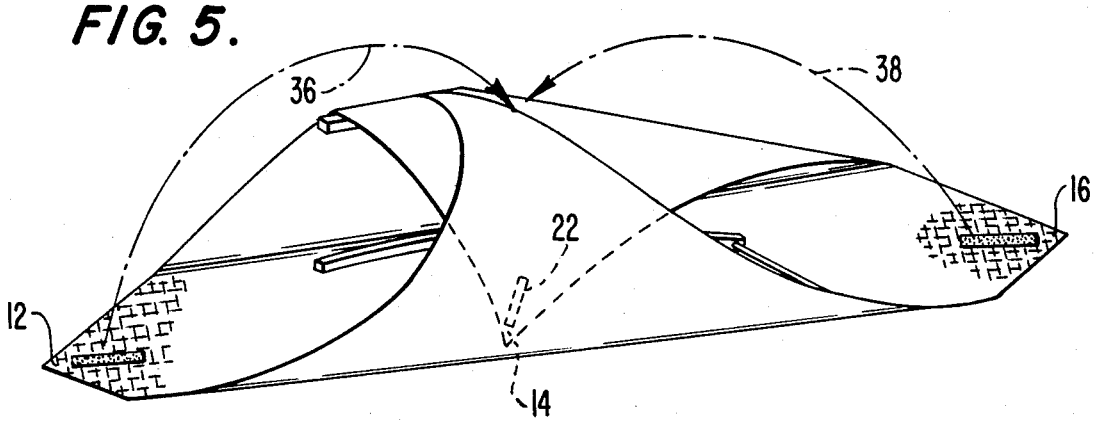
FIG. 5 is a perspective view illustrating the manner by which the article is wrapped in a pad and the latter is secured in its wrapped position by use of the present invention.

FIGS. 4 and 5 illustrate the manner of use of a single pad of the invention for wrapping around a chair 34. As can be seen the chair is placed on its back on the pad in a diagonal disposition. The corners 14, 18 which can be designated side corners or flaps, are sequentially folded over the sides of the chair but because the corners 14, 18 overlap each other far beyond any possibility of the strips in those corners overlapping, these corners of the pad are merely tucked down over the chair sides without making any use of the fastening strips. The opposite corners 12, 16, which may be designated end flaps, may then be folded over the end of the chair, in no specific order, but assuming that the corner 12 is first folded over as designated by the arrow 36, the strip 30, illustrated in FIG. 2, will be facing upwardly. When the corner 16 is folded over the chair as indicated by the arrow 38, the strip 24 will overlie the strip 30 and because they are of opposite types, they will releasably fasten together over the sides flaps to retain them in place while securing the pad in its position of use around the chair.

Though strips of one foot in length provide almost three feet of adjustability, which has been found to be adequate for most objects, it will be apparent that the range of adjustability, particularly for smaller objects, can be in increased by increasing the length of the strips, but for smaller objects it is not usually necessary to fasten the overlapping corners since there is often sufficient excess pad material that it can be tucked into crevasses on the object and be reasonably secured in place exactly as is currently done without use of the present invention.

Though the invention has been described as it would be used in connection with conventional furniture pads utilized by professional household goods movers, the invention can be used in a similar fashion on a wide variety of other flexible covers where it is desirable that the cover be capable of being securely fastened in place around an object.

The cover sheet need not be rectangular but could have other shapes having a periphery which is symmetrical with respect to the center of the sheet, the strips of Velcro being fixed to the sheet symmetrically with respect to its periphery and extending from positions adjacent the periphery towards the center of the sheet. The present invention thus is susceptible of a variety of changes and modifications without, however, departing from the scope and spirit of the appended claims.

What is claimed is:

1. A shipping pad for use in the moving industry comprising a rectangular flexible sheet of a size to wrap around an article and thickness sufficient to protect said article against marring and superficial damage during handling, transport and storage, a first strip of "Velcro" diagonally fixed to each corner on one side of said sheet, a second strip of "Velcro" diagonally fixed to each corner on the opposite side of said sheet, each of said second strips substantially overlying one of said first strips to define pairs of substantially back-to-back strips on opposite sides of each corner of said sheet, all of the strips on one side of said sheet being of the female variety and all the strips on the other side of said sheet being of the male variety.

2. The pad of claim 1 wherein said pairs of back-to-back strips are positioned on said sheet so as to overlie similarly positioned strips on a second sheet for releasably connecting said sheets together for covering and protecting an article too large to be covered and protected by a single sheet.

3. The pad of claim 1 wherein said thickness is provided by quilting.

* * * * *